US010076164B2

(12) United States Patent
Collins

(10) Patent No.: US 10,076,164 B2
(45) Date of Patent: Sep. 18, 2018

(54) JEWELRY CATCH

(71) Applicant: Martin A. Collins, Dallas, GA (US)

(72) Inventor: Martin A. Collins, Dallas, GA (US)

(73) Assignee: DREAM CATCH INC., Aeworth, GA (US)

( * ) Notice: Subject to any disclaimer, the term of this patent is extended or adjusted under 35 U.S.C. 154(b) by 310 days.

(21) Appl. No.: 15/146,092

(22) Filed: May 4, 2016

(65) Prior Publication Data

US 2016/0324276 A1 Nov. 10, 2016

Related U.S. Application Data

(60) Provisional application No. 62/157,613, filed on May 6, 2015.

(51) Int. Cl.
*A44C 5/20* (2006.01)
*A44C 5/18* (2006.01)

(52) U.S. Cl.
CPC ..... *A44C 5/2038* (2013.01); *A44C 5/185* (2013.01)

(58) Field of Classification Search
CPC ..... F16B 45/06; F16B 45/02; A44B 13/02; Y10T 24/44291; Y10T 24/44376; Y10T 24/44385; Y10T 24/45293; Y10T 24/45424; Y10T 24/44692; Y10T 24/45319; Y10T 24/45361; Y10T 24/4533; Y10T 24/4447; Y10T 24/45346; Y10T 24/3437; Y10T 24/44855; Y10T 24/45355; A44C 5/185; A44C 5/20; A44C 5/2033; A44C 5/2038; A44C 5/2019; A44C 5/2023; A44C 5/2028; F16G 11/10; B60C 27/08
USPC ..... 24/489, 598.5, 513
See application file for complete search history.

(56) References Cited

U.S. PATENT DOCUMENTS 1,367,270 A * 2/1921 McKinney ..... F16B 45/06 24/598.5

* cited by examiner

*Primary Examiner* — Jack W Lavinder
(74) *Attorney, Agent, or Firm* — Thomas Horstemeyer, LLP

(57) ABSTRACT

Disclosed are various examples of a jewelry catch. The jewelry catch can include a base eyelet comprising an anchor eye, a pivot eye and a bar that connects the anchor eye to the pivot eye. The jewelry catch can also include a double eyelet that includes a catch eye and a jewelry eye. Further, the jewelry catch can include a male clasp that includes a hook protruding from the male clasp and configured to slide into a channel shaped to receive the hook. Likewise, the jewelry catch can include a female clasp that includes a channel shaped to receive the hook, thereby securing the male clasp to the female clasp through friction between the hook of the male clasp and the channel of female clasp when the jewelry catch is in a closed position.

17 Claims, 6 Drawing Sheets

JEWELRY CATCH

CROSS REFERENCE TO RELATED APPLICATIONS

This application claims priority to, and the benefit of, U.S. Provisional Patent Application 62/157,613, entitled "JEWELRY CATCH" and filed on May 6, 2015, which is incorporated by reference as if set forth herein in its entirety.

BACKGROUND

Jewelry catches are used to secure items of jewelry, such as necklaces, neck pieces, bracelets, and other jewelry, in a manner that prevents the jewelry from falling off of the wearer. As part of a piece of jewelry, a jewelry catch may also be designed in a manner intended to match or compliment the aesthetic of the piece of jewelry using the catch. Various designs and approaches have been used to satisfy the functional and aesthetic requirements of jewelry catches.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Disclosed are various embodiments of a jewelry catch. As further illustrated and described herein, the jewelry catch functions to secure a piece of jewelry to the wearer. The jewelry catch may include a curved tongue to secure the piece of jewelry to the wearer. In some examples, the curved tongue may include a bump to further secure the piece of jewelry to the wearer. In other examples, the bump can be located on the inside of the female clasp. In these examples, a depression can be located on the curved tongue to engage the bump, further securing the jewelry catch. In some examples, the jewelry catch may be enclosed for aesthetic reasons. In those examples, a top, box, or case may be attached to the jewelry catch. However, in some instances, the jewelry catch may be configured to allow for the use of detachable top, box, or case, permitting a jeweler to use the catch for a wide variety of jewelry by using the same type of jewelry catch, but a different top, box, or case, for each piece of jewelry.

Figure 1:
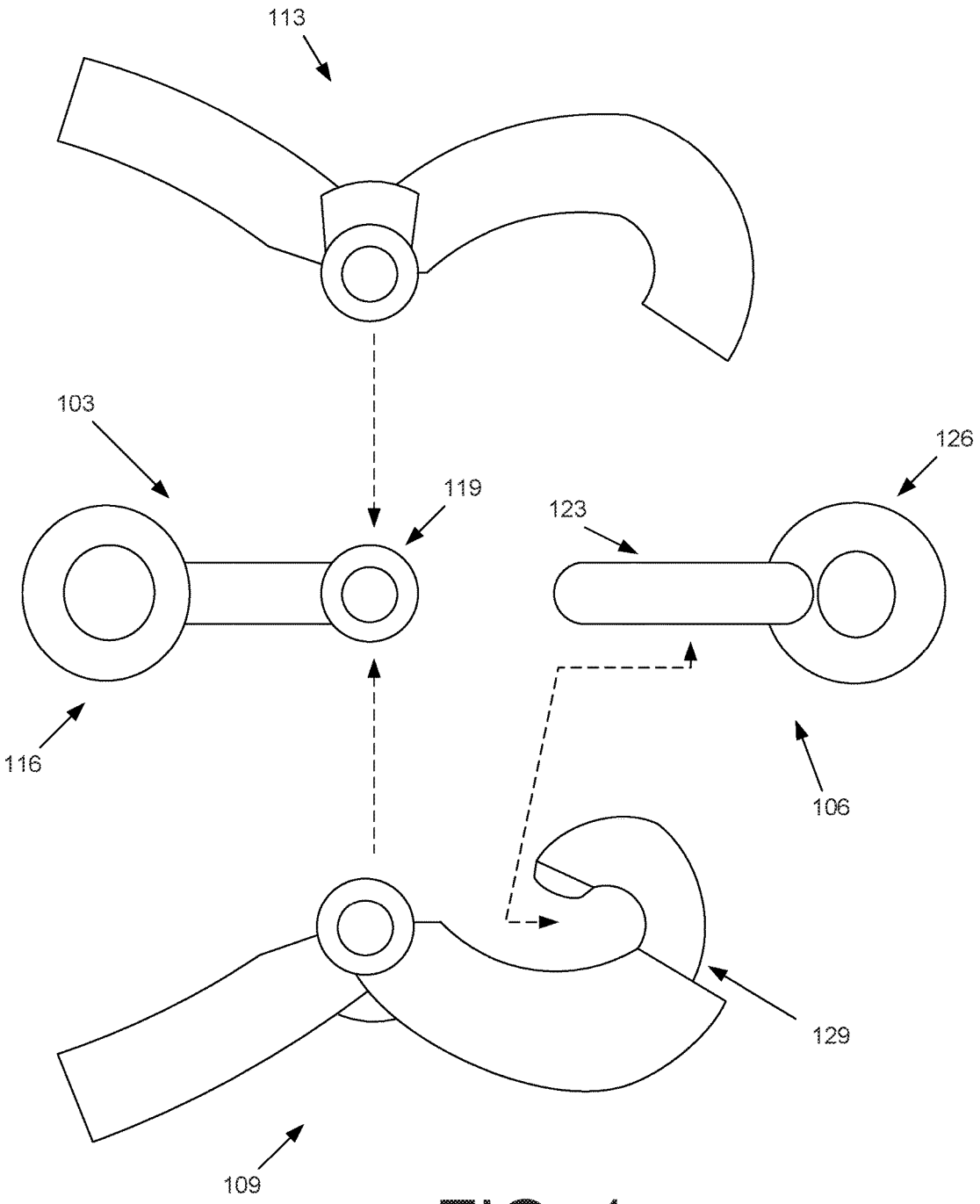
FIG. 1 is an exploded view of various examples of the jewelry catch with indications of how the various parts of the jewelry catch are assembled together.

Beginning with FIG. 1, shown is an exploded view of various examples of a jewelry catch. The jewelry catch includes a number of components. These include a base eyelet 103, a double eyelet 106, a male clasp 109, a female clasp 113, and potentially other components.

The base eyelet 103 includes an anchor eye 116 connected to a pivot eye 119 by a bar, as illustrated. The anchor eye 116 allows for a portion of a piece of jewelry, such as necklace, bracelet, or other piece of jewelry, to be threaded through it, serving as an anchor point for a first end of the piece of jewelry to the catch. The pivot eye 119 allows for a fastener, such as a split pin, R fastener, a threaded axle (e.g. a rod with both ends threaded for a cap to screwed onto each end of the rod), a straight wire or straight pin, or other fastener, to pass through. This allows the male clasp 109 and the female clasp 113 to be joined to the base eyelet 103. In some instances, the fastener may be permanently attached to the jewelry catch. For example, the straight wire, straight pin, or other fasteners, may be welded to the male clasp 109 and/or female clasp 113.

The double eyelet 106 includes two eyes set perpendicular to each other, although other angles are possible. The catch eye 123 is made to be sufficiently large enough for the jewelry catch to be threaded through it, allowing to jewelry catch to clasp the second end of the piece of jewelry. The jewelry eye 126 allows for a portion of a piece of jewelry, such as a necklace, bracelet, or other piece of jewelry, to be threaded through it, serving as an anchor point for the second end of the piece of jewelry. As such, the jewelry eye 126 serves a similar functional purpose as the anchor eye 116.

The jewelry catch also includes two clasps—a male clasp 109 and a female clasp 113. The male clasp 109 serves to catch or grasp the female clasp 113. Protruding from the male clasp 109 is a hook 129. When the jewelry catch is closed, the hook 129 extends through the catch eye 123 into the female clasp 113. The female clasp 113 has a channel shaped to receive the hook 129. The channel is further depicted in FIG. 6 and described in further detail below. As the curved hook 129 slides into the channel, friction secures the hook 129 inside the female clasp 113. This causes the hook 129 to holds the male clasp 109 and female clasp 113 together by resisting attempts to pull the male clasp 109 from the female clasp 113.

The male clasp 109 and the female clasp 113 can be manufactured in various shapes other than the ones depicted. For example, the male clasp 109 and the female clasp could be shaped as two halves of a box, wherein the portion of the box corresponding to the male clasp 109 includes the hook 129 and the portion of the box corresponding to the female clasp 113 includes the channel within the interior. As another example, a shell that encases the jewelry catch can be attached to the male clasp 109 and the female clasp 113. In such embodiments, when the male clasp 109 and the female clasp 113 are joined together, the jewelry catch can be hidden by being enclosed within the case formed from the two shells.

Figure 2:
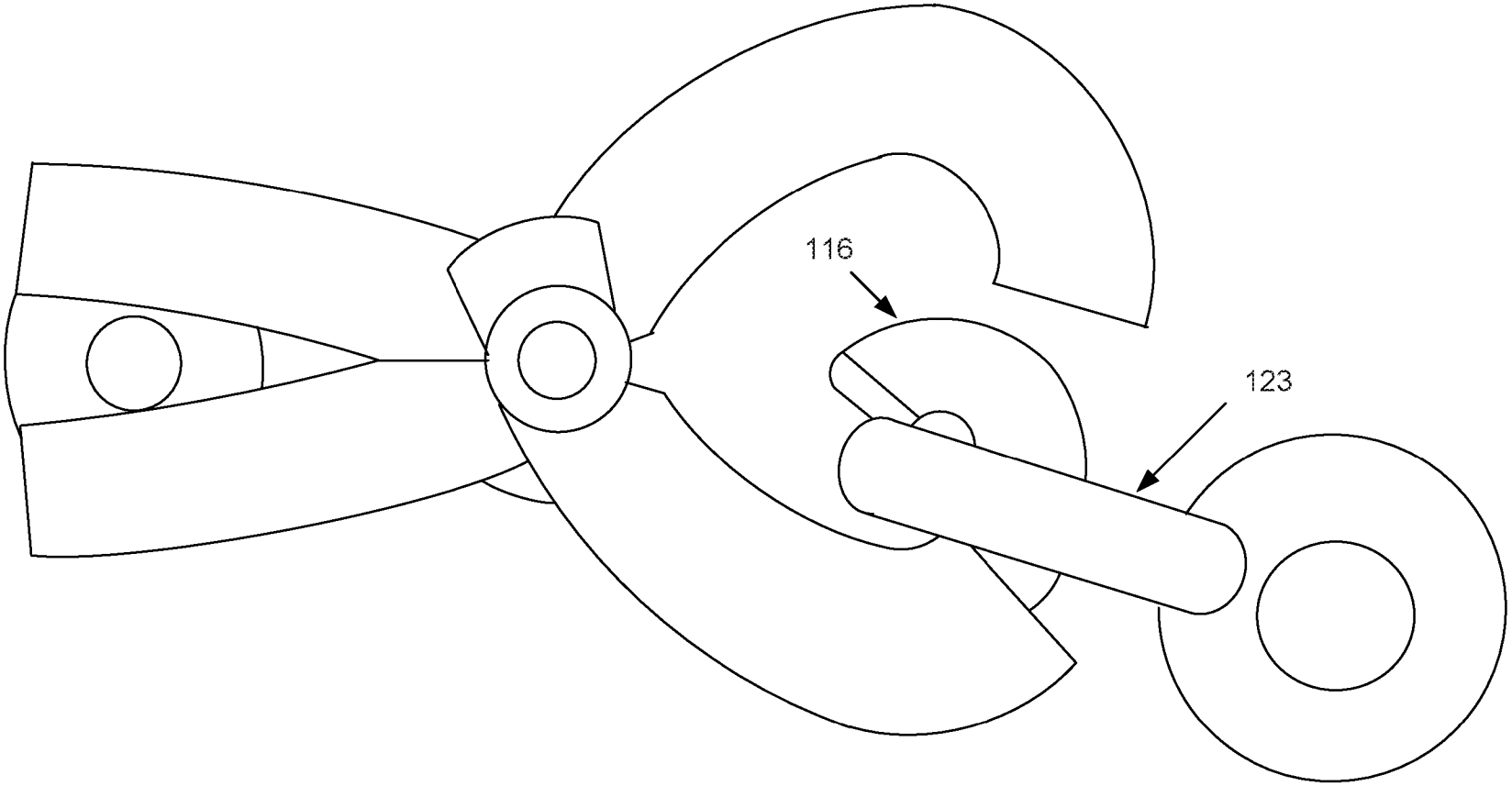
FIG. 2 is a view of an example of the jewelry catch assembled according to the depiction of FIG. 1 and left in the open position.

Proceeding to FIG. 2, shown is a depiction of the jewelry catch assembled in the manner previously depicted in FIG. 1. In FIG. 2, the jewelry catch is depicted in the open position. As shown, the hook 129 is extended through the catch eye 123.

Figure 3:
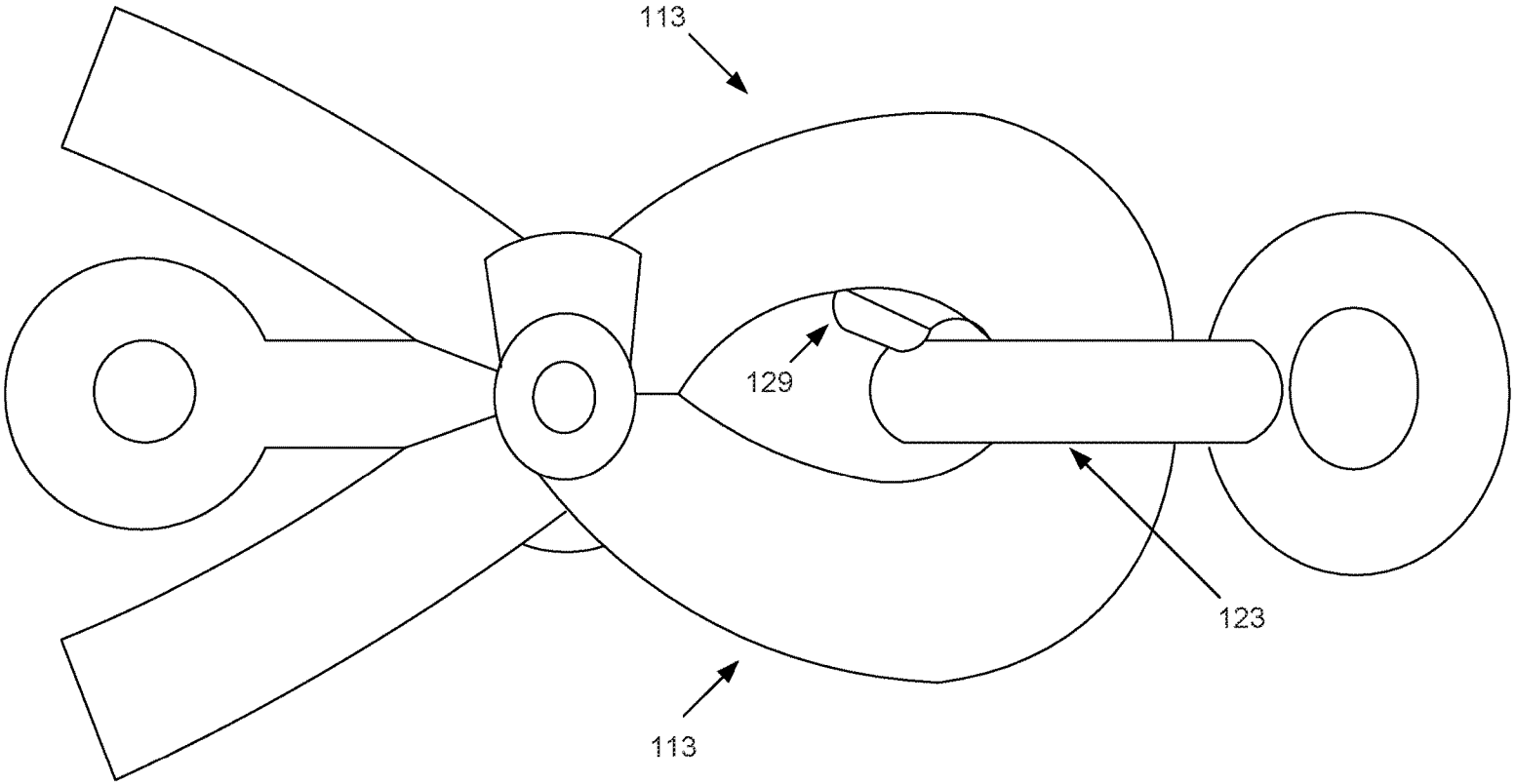
FIG. 3 is a view of an example of the jewelry catch assembled according to the depiction of FIG. 1 and left in the closed position.

Moving on to FIG. 3, shown is a depiction of the jewelry catch assembled in the manner previously depicted in FIG.

1. In FIG. 3, the jewelry catch is depicted in the closed position. The hook 129 has been threaded through the catch eye 123 and inserted into the groove of the female clasp 113. As a result, the male clasp and the female clasp 113 are affixed together through the catch eye 123, secure the first end of the piece of jewelry to the second end of the piece of jewelry.

Figure 4:
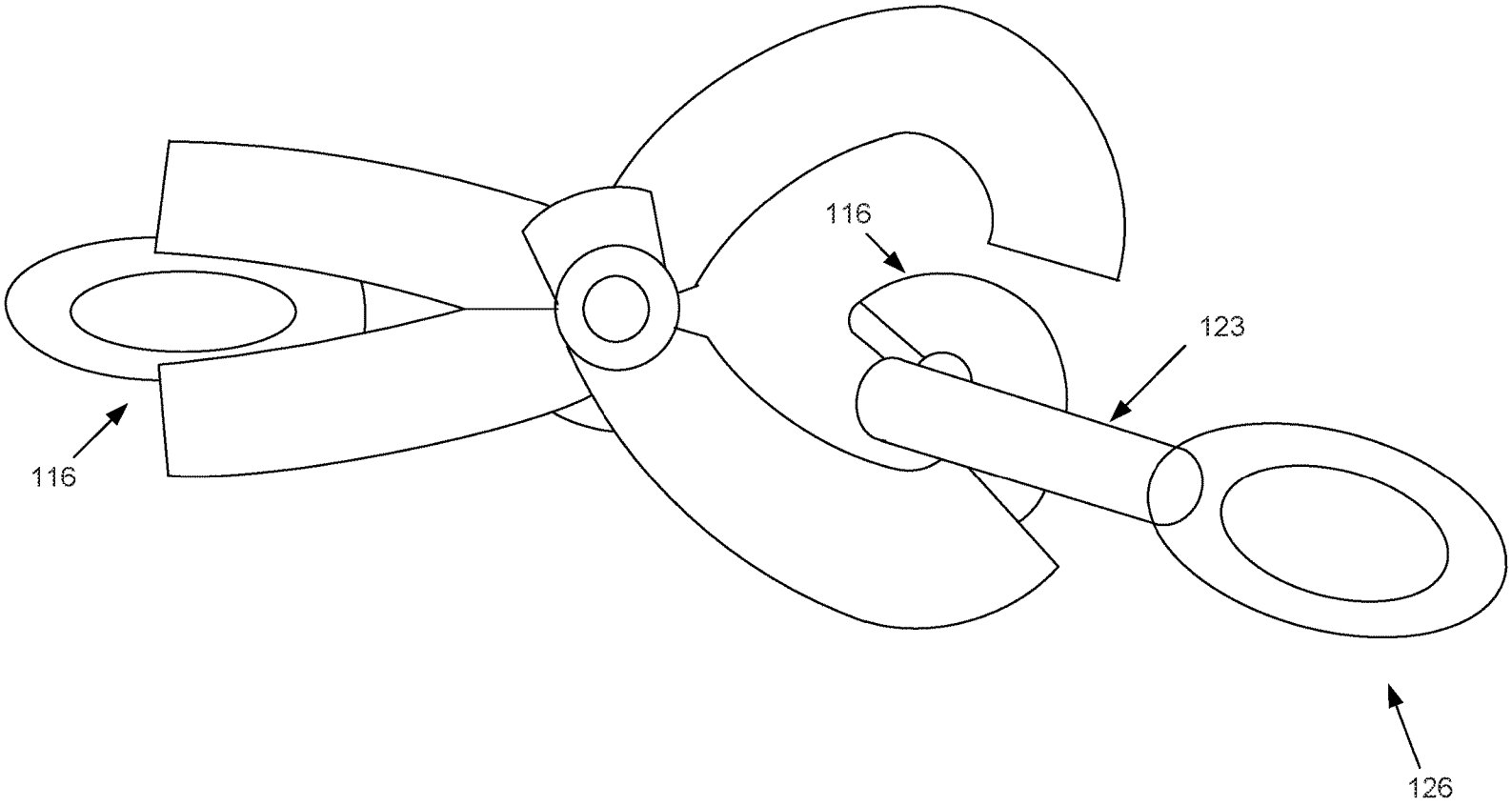
FIG. 4 is a view of an alternative example of the jewelry catch assembled according to the depiction of FIG. 1 and left in the open position.

Referring next to FIG. 4, shown is a depiction of an alternative example of the jewelry catch assembled in the manner previously depicted in FIG. 1. In FIG. 4, the jewelry catch is depicted in the open position. As shown, the hook 129 is extended through the catch eye 123. In contrast to the example depicted in FIG. 2, however, the example depicted in FIG. 4 includes an elongated anchor eye 116 and an elongated jewelry eye 126.

Using an elongated anchor eye 116 and an elongated jewelry eye 126 provide a wearer with a better grip compared to a circularly shaped anchor eye 116 or circularly shaped jewelry eye 126, making the jewelry catch easier to operate. Accordingly, the elongated anchor eye 116 and the elongated jewelry eye 126 can be elliptically shaped, as illustrated in FIG. 4, in order for the elongated anchor eye 116 and the elongated jewelry eye 126 to protrude further from the jewelry catch. However, the elongated anchor eye 116 and the elongated jewelry eye 126 can be configured in other shapes, so long as the length of the elongated anchor eye 116 and the length of the elongated jewelry eye 126 exceed the respective width of the elongated anchor eye 116 and the width of elongated jewelry eye 126.

Figure 5:
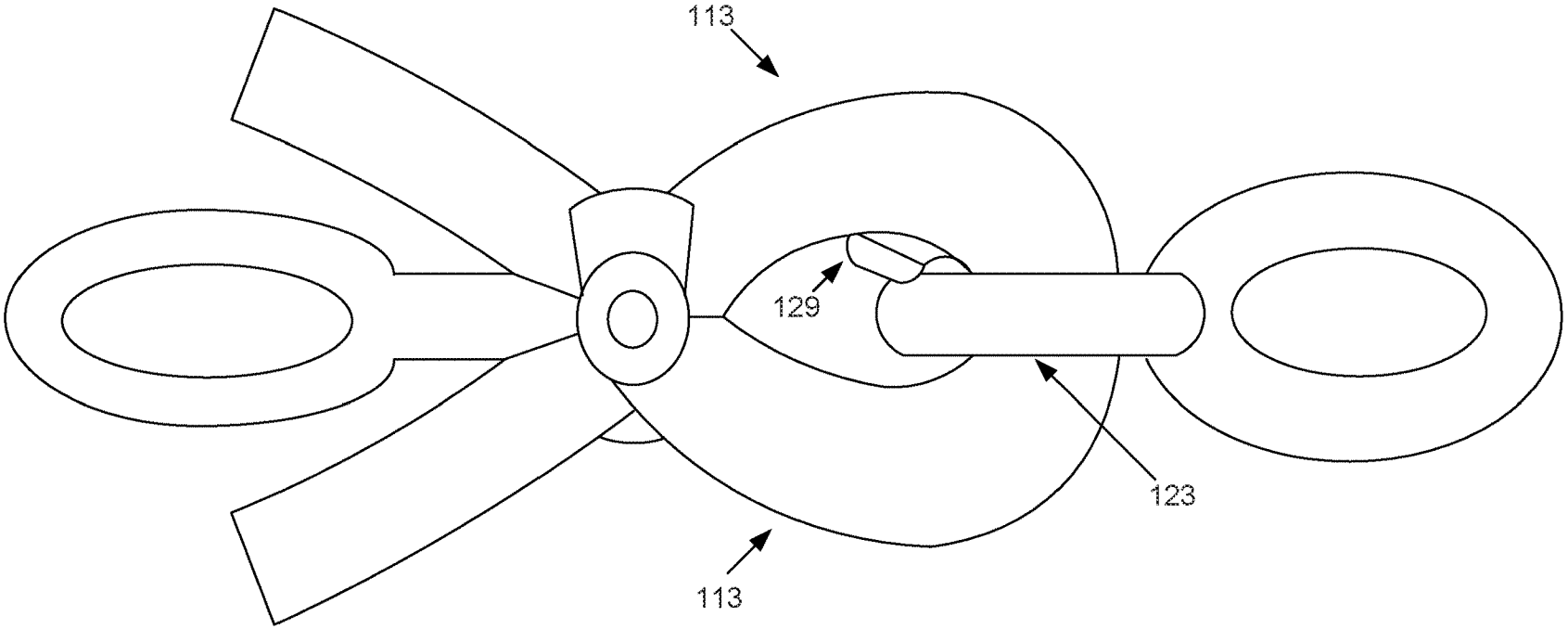
FIG. 5 is a view of an alternative example of the jewelry catch assembled according to the depiction of FIG. 1 and left in the closed position.

Proceeding to FIG. 5, shown is a depiction of the jewelry catch assembled in the manner previously depicted in FIG. 1. In FIG. 5, the jewelry catch is depicted in the closed position. The hook 129 has been threaded through the catch eye 123 and inserted into the groove of the female clasp 113. As a result, the male clasp and the female clasp 113 are affixed together through the catch eye 123, secure the first end of the piece of jewelry to the second end of the piece of jewelry. In contrast to the example depicted in FIG. 3, however, the example depicted in FIG. 5 includes an elongated anchor eye 116 and an elongated jewelry eye 126.

Figure 6:
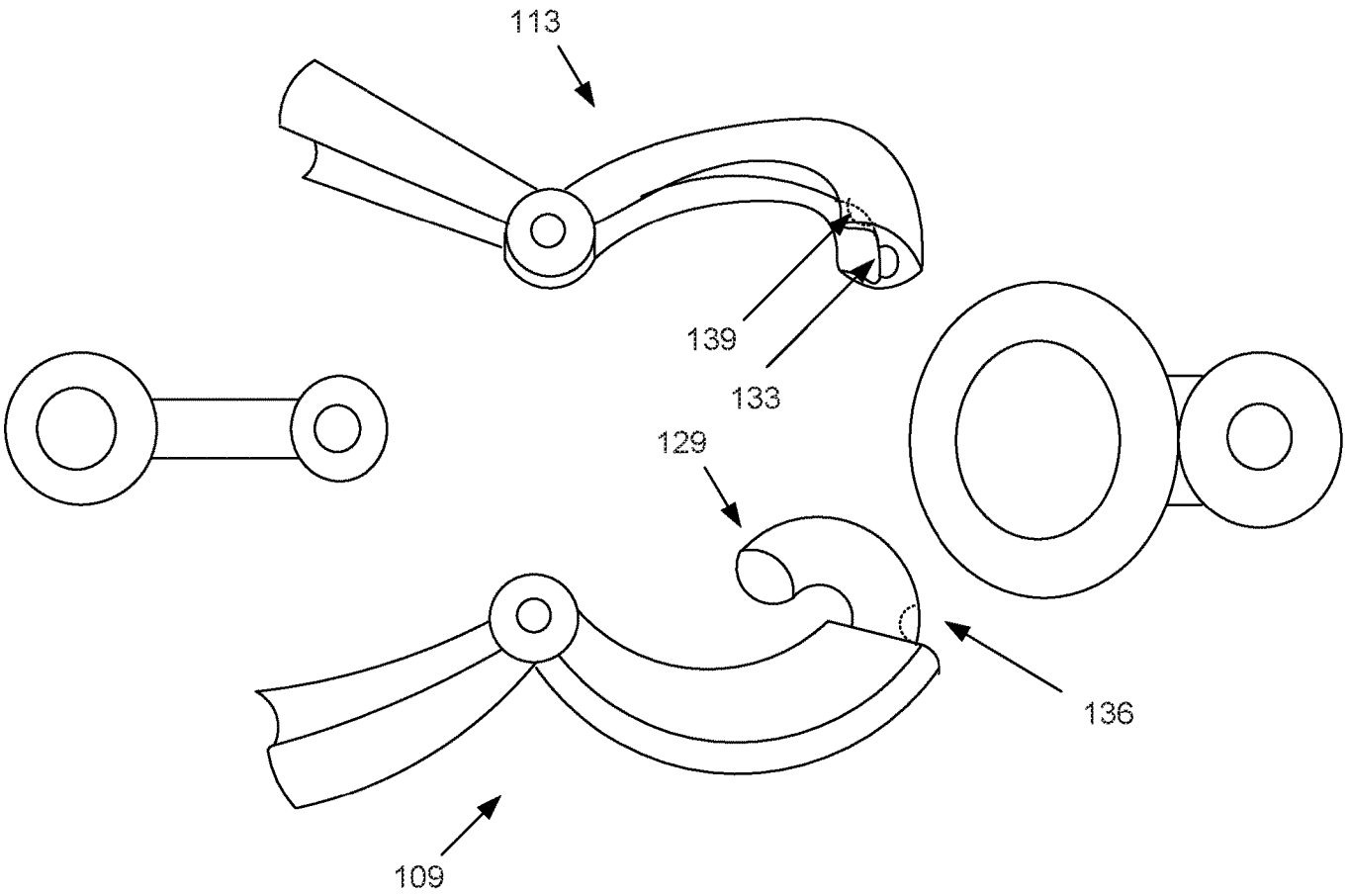
FIG. 6 is an exploded view of various examples of the jewelry catch illustrating a channel in the female clasp of the jewelry catch.

Moving to FIG. 6, shown is another exploded view, similar to the view depicted in FIG. 1, of the jewelry catch. Illustrated are the male clasp 109 and the female clasp 113. Likewise, a hook 129 protrudes from the male clasp 109. The female clasp 113 includes a channel 133 on the inside of the female 113. The channel 133 is configured or shaped to receive the hook 129, such that the static friction between the surface of the hook 129 and the surface of the channel 133 keeps the jewelry catch in the closed position. Preferentially, the width of the hook 129 and the width of the channel 133 are no more than one-third of the interior width of the male clasp 109 or female clasp 113, respectively. This ratio allows the jewelry catch to operate with less friction, therefore giving the jewelry catch a smoother closure. In addition, it reduces the overall weight of the jewelry catch compared to larger, wider hooks 129.

In some instances, a depression 136 can be included in proximity to the base of the hook 129. The depression 136 can be shaped to fit a corresponding bump 139 located on the inside of the channel 133 at a corresponding location. When the male clasp 109 and the female clasp 113 are joined together, the hook 129 and channel 133 can be angled so that the hook 129 slides over the bump 139 before the bump 139 engages the depression 136 to help anchor the male clasp 109 and the female clasp 113 together.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims. For example, various embodiments of the jewelry catch can be attached to various necklaces, bracelets, and other jewelry.

I claim:

1. A jewelry catch, comprising:

a base eyelet comprising an anchor eye, a pivot eye and a bar that connects the anchor eye to the pivot eye;

a double eyelet comprising a catch eye and a jewelry eye a male clasp comprising a hook protruding from the male clasp and configured to slide into a channel shaped to receive the hook, the hook having a width that is no greater than one-third of a width of the male clasp; and a female clasp comprising the channel shaped to receive the hook, thereby securing the male clasp to the female clasp through friction between the hook of the male clasp and the channel of female clasp when the jewelry catch is in a closed position.

2. The jewelry catch of claim 1, wherein the catch eye is sized for the jewelry catch to be threaded with a jewelry chain through the catch eye.

3. The jewelry catch of claim 1, wherein the male clasp comprises a first shell and the female clasp comprises a second shell.

4. The jewelry catch of claim 3, wherein the male clasp and the female clasp are enclosed within the first shell and the second shell when the male clasp and the female clasp are joined together with the hook and the channel.

5. The jewelry catch of claim 1, wherein the length of the anchor eye exceeds the width of the anchor eye.

6. The jewelry catch of claim 1, wherein the length of the jewelry eye exceeds the width of the jewelry eye.

7. An apparatus, comprising:

a base eyelet comprising an anchor eye, a pivot eye and a bar that connects the anchor eye to the pivot eye;

a double eyelet comprising a catch eye and a jewelry eye a male clasp comprising:

a first shell, and a hook protruding from the male clasp and configured to slide into a channel shaped to receive the hook;

a female clasp comprising:

a second shell, and the channel shaped to receive the hook, thereby securing the male clasp to the female clasp through friction between the hook of the male clasp and the channel of female clasp when the jewelry catch is in a closed position; and wherein the male clasp and the female clasp are enclosed within the first shell and the second shell when the male clasp and the female clasp are joined together with the hook and the channel.

8. The apparatus of claim 7, wherein the catch eye is sized for the jewelry catch to be threaded with a jewelry chain through the catch eye.

9. The apparatus of claim 7, wherein the width of the hook is no greater than one-third of the width of male clasp.

10. The apparatus of claim 7, wherein the length of the anchor eye exceeds the width of the anchor eye.

11. The apparatus of claim 7, wherein the length of the jewelry eye exceeds the width of the jewelry eye.

12. A device, comprising:

a base eyelet comprising an anchor eye, a pivot eye and a bar that connects the anchor eye to the pivot eye;

a double eyelet comprising a catch eye and a jewelry eye a male clasp comprising:

a first shell, and a hook protruding from the male clasp and configured to slide into a channel shaped to receive the hook; and a female clasp comprising a second shell, and the channel shaped to receive the hook, thereby securing the male clasp to the female clasp through friction between the hook of the male clasp and the channel of female clasp when the jewelry catch is in a closed position.

13. The device of claim 12, wherein the catch eye is sized for the jewelry catch to be threaded with a jewelry chain through the catch eye.

14. The device of claim 12, wherein the width of the hook is no greater than one-third of the width of male clasp.

15. The device of claim 12, wherein the length of the anchor eye exceeds the width of the anchor eye.

16. The device of claim 12, wherein the length of the jewelry eye exceeds the width of the jewelry eye.

17. The device of claim 12, wherein the male clasp and the female clasp are enclosed within the first shell and the second shell when the male clasp and the female clasp are joined together with the hook and the channel.

* * * * *